US010046438B2

(12) United States Patent
Tchakarov

(10) Patent No.: US 10,046,438 B2
(45) Date of Patent: Aug. 14, 2018

(54) POLISHING OR GRINDING PAD ASSEMBLY

(71) Applicant: DIAMOND TOOL SUPPLY, INC., Monroe, MI (US)

(72) Inventor: Tchavdar V. Tchakarov, Monroe, MI (US)

(73) Assignee: Diamond Tool Supply, Inc., Monroe, MI (US)

( * ) Notice: Subject to any disclaimer, the term of this patent is extended or adjusted under 35 U.S.C. 154(b) by 0 days.

(21) Appl. No.: 15/690,416

(22) Filed: Aug. 30, 2017

(65) Prior Publication Data

US 2017/0361423 A1 Dec. 21, 2017

Related U.S. Application Data

(63) Continuation-in-part of application No. PCT/US2016/053355, filed on Sep. 23, 2016.

(60) Provisional application No. 62/232,123, filed on Sep. 24, 2015.

(51) Int. Cl.

| | |
|---|---|
| ***B24D 7/08*** | (2006.01) |
| ***B24D 18/00*** | (2006.01) |
| ***B24D 11/00*** | (2006.01) |
| *B24B 7/18* | (2006.01) |

(52) U.S. Cl.

CPC ..... *B24D 7/08* (2013.01); *B24D 11/00* (2013.01); *B24D 18/0072* (2013.01); *B24B 7/186* (2013.01)

(58) Field of Classification Search

CPC ..... B24D 7/08; B24D 11/00; B24D 18/0072
USPC ..... 451/526, 527, 538, 539, 353, 359, 449
See application file for complete search history.

(56) References Cited

U.S. PATENT DOCUMENTS

| | | | | |
|---|---|---|---|---|
| 2,174,902 A * | 10/1939 | Stratford | B24D 9/08 451/510 |
| 2,225,193 A | 12/1940 | Benner et al. | |
| 2,425,368 A | 8/1947 | Doermann | |
| 2,819,568 A * | 1/1958 | Kasick | B24D 7/10 451/449 |
| 3,121,982 A | 2/1964 | Miller | |
| 3,464,166 A | 9/1969 | Bouvier | |
| 3,487,589 A * | 1/1970 | Binkley | B24B 27/06 451/541 |
| 3,517,466 A | 6/1970 | Bouvier | |

(Continued)

FOREIGN PATENT DOCUMENTS

DE 202015101442 U1 5/2015

OTHER PUBLICATIONS

Diamond Tool Supply, Inc., "Monroe Floor Polishing Systems," www.diamondtoolsupply.com, published prior to Sep. 24, 2015, 14 pages.

(Continued)

*Primary Examiner* — George Nguyen
(74) *Attorney, Agent, or Firm* — Harness, Dickey & Pierce, P.L.C.

(57) ABSTRACT

A floor polishing or grinding pad assembly is provided. In one aspect, a polishing or grinding pad assembly employs a flexible pad, a reinforcement layer or ring, and multiple floor-contacting tools such as abrasive disks. In another aspect, the reinforcement layer includes a wavy or undulating internal edge shape. A further aspect includes an inner ring edge having radially extending slots between pairs of radially enlarged tool mounting peaks. Still another aspect includes an insulator or spacer between a head of an abrasive tool and a reinforcement ring.

62 Claims, 11 Drawing Sheets

(56) References Cited

U.S. PATENT DOCUMENTS 3,934,377 A 1/1976 Tertinek
4,554,765 A * 11/1985 Grimes ..... B24D 13/14 451/490
4,694,615 A * 9/1987 MacKay, Jr. ..... B24B 45/00 451/342
4,724,567 A * 2/1988 Rones ..... A47L 11/164 15/230.14
4,874,478 A * 10/1989 Ishak ..... B24D 3/002 204/157.15
5,020,280 A * 6/1991 O'Reilly ..... B24B 23/02 125/13.01
5,054,245 A 10/1991 Coty
5,076,023 A 12/1991 Saguchi
5,247,765 A 9/1993 Quintana
5,567,503 A 10/1996 Sexton et al.
5,586,930 A 12/1996 Hayashi et al.
5,605,493 A 2/1997 Donatelli et al.
5,632,790 A * 5/1997 Wiand ..... B24B 7/22 51/293
5,782,682 A 7/1998 Han et al.
6,196,911 B1 3/2001 Preston et al.
6,234,886 B1 5/2001 Rivard et al.
6,298,518 B1 * 10/2001 Umbrell ..... A47L 11/164 15/230
6,299,522 B1 10/2001 Lee
7,059,801 B2 6/2006 Snyder et al.
7,104,739 B2 9/2006 Lagler
7,147,548 B1 * 12/2006 Mehrabi ..... B24B 7/186 451/323
7,204,745 B2 * 4/2007 Thysell ..... A47L 11/164 451/344
D612,874 S 3/2010 Nilsson et al.
7,670,208 B2 3/2010 Thysell et al.
7,744,447 B2 6/2010 Kodani et al.
7,815,393 B2 10/2010 Snyder et al.
8,147,297 B2 4/2012 Hamm et al.
8,176,909 B2 5/2012 Ilgner
8,272,924 B2 9/2012 Van Eijden et al.
8,464,420 B2 6/2013 Ye
D743,456 S 11/2015 Shinozaki
9,174,326 B2 11/2015 Ahonen
9,925,645 B2 3/2018 Song et al.
2004/0009744 A1 * 1/2004 Conley ..... B24D 7/10 451/359
2005/0164620 A1 7/2005 Amamoto
2007/0254568 A1 11/2007 Park
2007/0292207 A1 12/2007 Reed et al.
2009/0190999 A1 7/2009 Copoulos
2009/0191799 A1 * 7/2009 Rivard ..... B24D 9/085 451/259
2010/0190421 A1 * 7/2010 Hamm ..... B24B 7/186 451/353
2011/0053468 A1 * 3/2011 Vontell ..... B24B 57/02 451/53
2011/0195644 A1 * 8/2011 Gallup ..... B24B 41/066 451/442
2011/0223845 A1 9/2011 Van Der Veen et al.
2011/0300784 A1 12/2011 Tchakarov et al.
2012/0270483 A1 10/2012 Bae et al.
2013/0225051 A1 8/2013 Vankouwenberg
2013/0324021 A1 12/2013 Ryan
2015/0328742 A1 * 11/2015 Schuele ..... B25F 5/00 451/359
2016/0136772 A1 5/2016 Littlefield et al.
2016/0144485 A1 * 5/2016 Ruan ..... B24D 13/147 451/539
2017/0361414 A1 * 12/2017 Tchakarov ..... B24B 41/047

OTHER PUBLICATIONS

Diamond Tool Supply, Inc., Various polishing and grinding parts, www.diamondtoolsupply.com, published prior to Sep. 24, 2015, 26 pages.
Wagman Metal Products Inc, "Concrete Finishing Tools," www.WagnamMetal.com, published prior to Sep. 14, 2016, 24 pages.
"Confidential/experimental sale from Diamond Tool Supply, Inc. to Wagman Metal Products on Sep. 1, 2016," 2 pages.
ISi GmbH, The System Manufacturer, Brochure Edition 12, Jan. 2017, 83 pages.
"Diamond Tools for Construction Stone," EHWA Diamond Ind. Co. Ltd. Catalogue, Published 2016, 60 pages.

* cited by examiner

POLISHING OR GRINDING PAD ASSEMBLY

CROSS-REFERENCE TO RELATED APPLICATIONS

This application is a continuation-in-part of PCT international Patent Application serial number PCT/US2016/053355, filed on Sep. 23, 2016, which claims the benefit of U.S. Provisional Application No. 62/232,123 filed on Sep. 24, 2015, which is incorporated by reference herein.

BACKGROUND AND SUMMARY

The disclosure relates generally to a pad assembly and more particularly to a floor polishing or grinding pad assembly.

It is known to use fibrous pads for polishing and grinding floors within industrial or commercial buildings. Such polishing or grinding pads are ideally suited for use on concrete, terrazzo, and natural (e.g., marble), engineered and composite stone floors. Examples of such pads and the powered machines used to rotate such can be found in the following U.S. patents and patent publication numbers: 2011/0300784 entitled "Flexible and Interchangeable Multi-Head Floor Polishing Disk Assemby" which was invented by Tchakarov et al. and published on Dec. 8, 2011; U.S. Pat. No. 9,174,326 entitled "Arrangement For Floor Grinding" which issued to Ahonen on Nov. 3, 2015; U.S. Pat. No. 6,234,886 entitled "Multiple Abrasive Assembly and Method" which issued to Rivard et al. on May 22, 2001; U.S. Pat. No. 5,605,493 entitled "Stone Polishing Apparatus and Method" which issued to Donatelli et al. on Feb. 25, 1997; and U.S. Pat. No. 5,054,245 entitled "Combination of Cleaning Pads, Cleaning Pad Mounting Members and a Base Member for a Rotary Cleaning Machine" which issued to Coty on Oct. 8, 1991. All of these patents and the patent publication are incorporated by reference herein.

Notwithstanding, improved floor polishing and grinding performance is desired. Furthermore, some of these prior constructions exhibit uneven wear in use which prematurely destroy the pads or cause inconsistent polishing or grinding.

In accordance with the present invention, a floor polishing or grinding pad assembly is provided. In one aspect, a polishing or grinding pad assembly employs a flexible pad, a reinforcement layer or ring, and multiple floor-contacting tools such as abrasive disks. In another aspect, the reinforcement layer includes a central hole through which a flexible pad is accessible and the pad at the hole has a linear dimension greater than a linear dimension of one side of the adjacent reinforcement layer. In yet another aspect, the reinforcement layer includes a wavy or undulating internal edge shape. A further aspect includes an inner ring edge having radially extending slots between pairs of radially enlarged tool mounting peaks. Still another aspect includes an insulator or spacer between a head of an abrasive tool and a reinforcement ring. A method of making and using a polishing or grinding pad assembly is also provided.

The present pad assembly is advantageous over traditional devices. For example, the present pad assembly advantageously allow greater floor contact with the pad within a centralized area generally surrounded by the disks, which is expected to improve polishing or grinding performance. Furthermore, the present pad assembly is considerably easier to install on a floor polishing or grinding machine than many prior constructions. The wavy, undulating, or alternating slotted and peaked inner edge of the ring allows different flexure characteristics during floor polishing or grinding, which also creating aesthetically pleasing ornamental designs. Moreover, the insulator or spacer feature reduces heat transfer from the abrasive tools to the reinforcement ring to reduce ring-to-pad adhesive degradation. Additional advantages and features of the present invention will be readily understood from the following description, claims and appended drawings.

DETAILED DESCRIPTION

Figure 1:
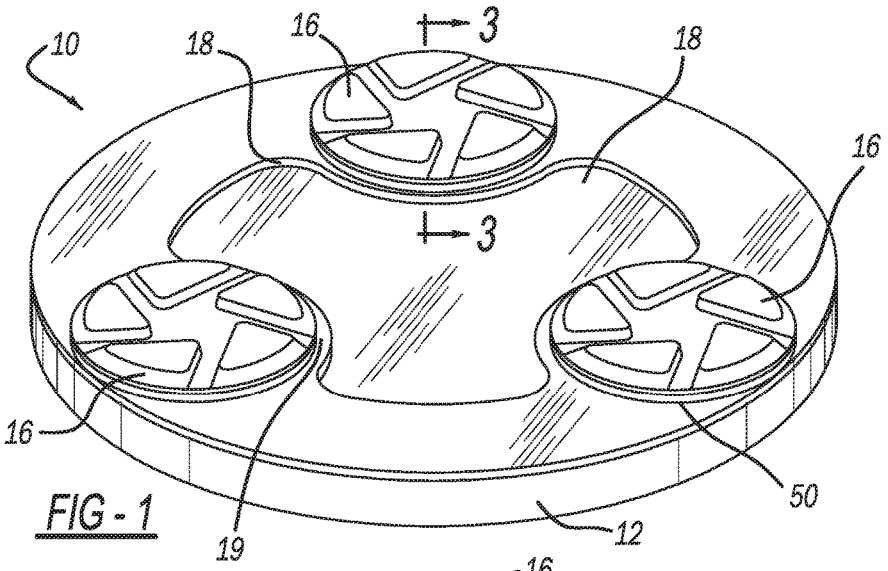
FIG. 1 is a bottom perspective view showing a first embodiment of the pad assembly.
Figure 2:
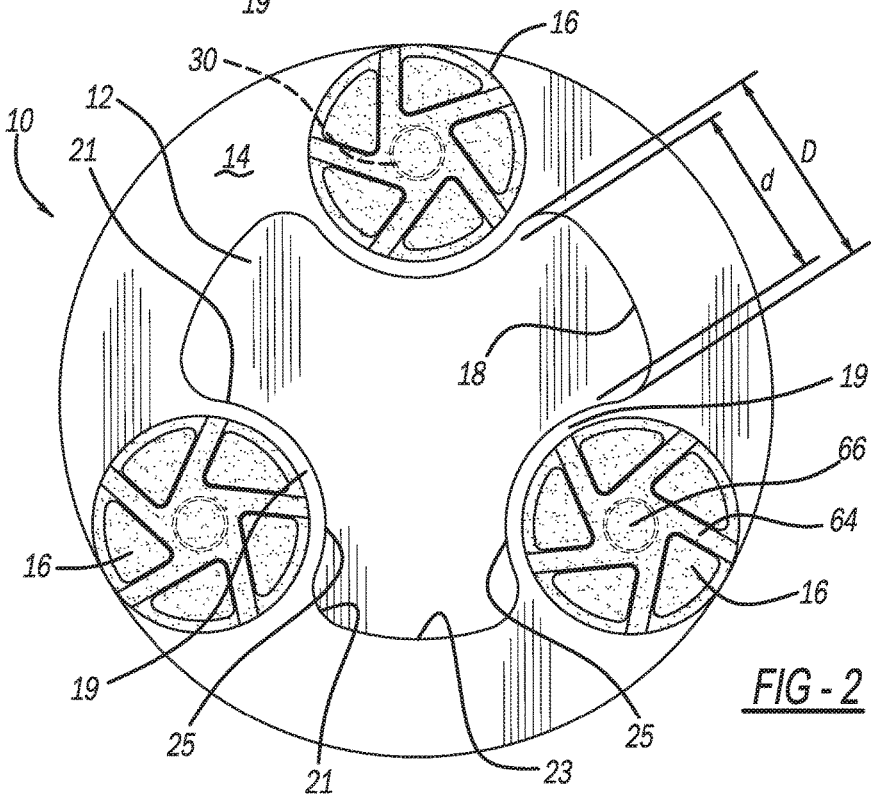
FIG. 2 is a bottom elevational view showing the first embodiment pad assembly.
Figure 3:
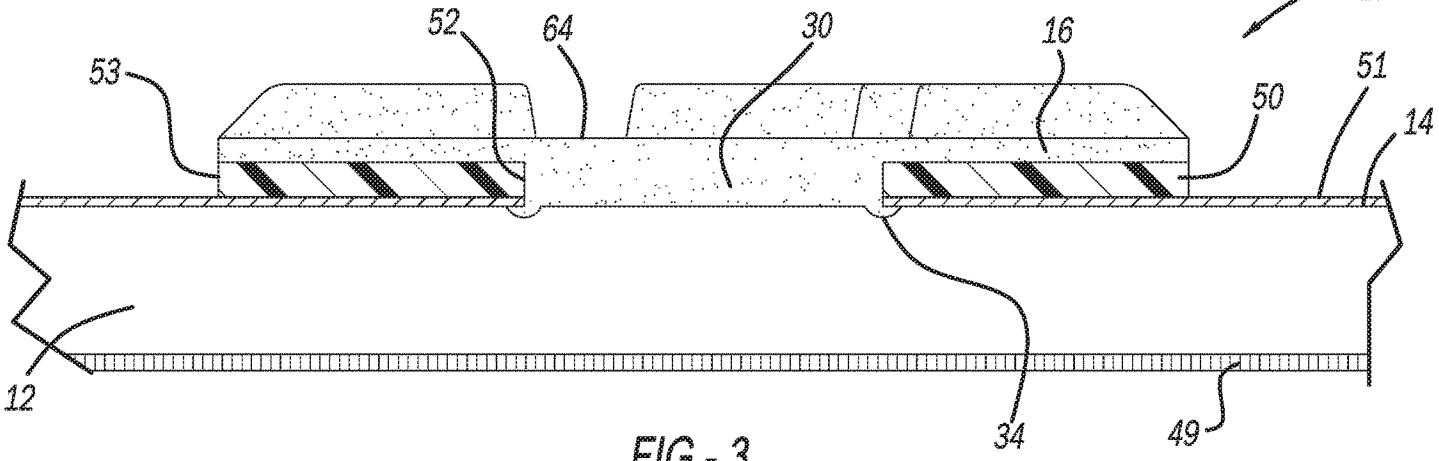
FIG. 3 is a fragmentary cross-sectional view, taken along line 3-3 of FIG. 1, showing the first embodiment pad assembly.
Figure 4:
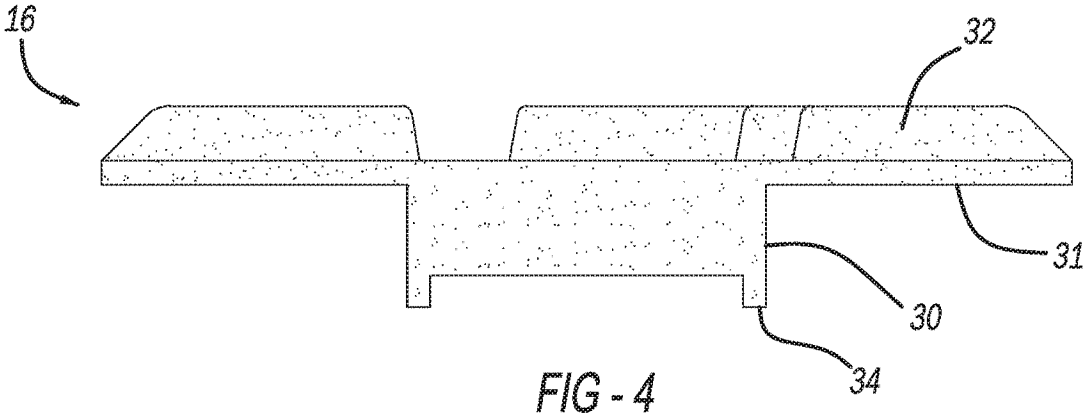
FIG. 4 is a side elevational view showing an abrasive disk employed in the first embodiment pad assembly.
Figure 5:
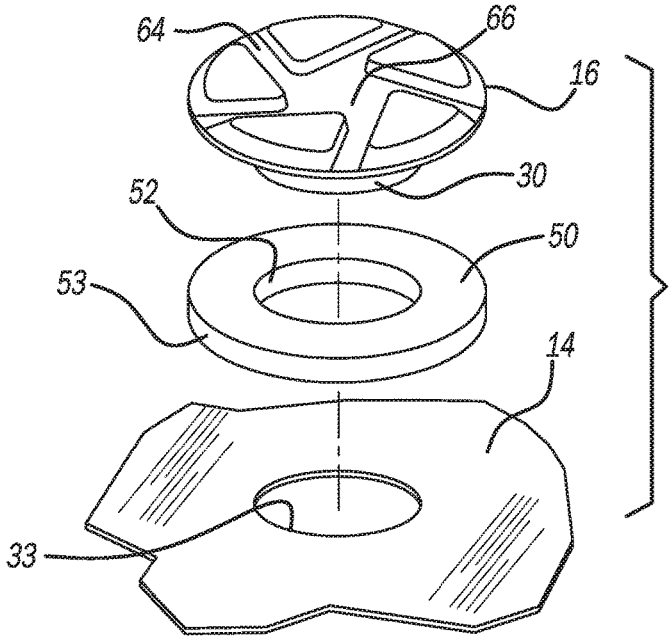
FIG. 5 is an exploded and bottom perspective view showing a portion of the first embodiment pad assembly.

A pad assembly 10 according to one embodiment is shown in FIGS. 1-5. Pad assembly 10 may be used for grinding or polishing composite surfaces, such as a concrete floor. Pad assembly 10 includes a wear-resistant base pad 12, which is preferably a flexible and deformable rubber or elastomeric polymeric material. Base pad 12 is generally circular, having a diameter of 150-360 mm and more preferably 177 mm, and having a thickness of 10-30 mm and more preferably 10 mm. Of course, base pad 12 could be made in other sizes.

A reinforcement ring or layer 14 is secured to one side of base pad 12, such as by adhesive. Reinforcement ring 14 is generally annular having a central opening defined by an inner edge 18. Reinforcement ring 14 is cut or stamped as a flexible metallic material, preferably spring steel, having a thickness greater than zero and up to 1.0 mm, and more preferably 0.5 mm. Reinforcement ring or layer 14 reinforces and adds some stiffness and toughness to the outer portion of pad 12, however, ring or layer 14 allows some flexibility to pad assembly 10 so it can flex with and follow any floor imperfections thereby producing uniform floor contact for polishing or grinding.

Inner edge 18 of reinforcement ring 14 has a wavy or undulating shape defining a central opening or hole which exposes a central surface 20 of base pad 12 therein. In this exemplary embodiment, inner edge 18 includes three radially extending slots 21 alternating with three partially circular peaks 19. Thus, a slot is between each pair of peaks. The edge of each slot 21 has an entirely smoothly curved configuration with a laterally enlarged terminal end 23 of a larger dimension D outward of a smaller dimension d at closer necks 25. Furthermore, slot 21 has a generally kieroid or mirrored S-shape when viewed like FIG. 2. Base pad 12 and ring 14 preferably have aligned circular peripheral surfaces.

A plurality of abrasive tools or floor-contacting disks 16 are secured to the outer surface of the reinforcement ring 14. In the example shown, abrasive tools 16 are approximately 2 inch disks of diamond particles in a polymeric resin matrix. In the example shown, three such abrasive tools or disks 16 are secured about the circumference of reinforcement ring 14. Different sizes and different compositions of abrasive tools or disks 16 could be used. For example, disks 16 may include a metallic material. Alternately, the abrasive tools may have polygonal peripheral shapes.

A cylindrically shaped post 30 projects from a backside 31 of a laterally enlarged abrasive body 32 of each disk 16 in a longitudinal direction substantially parallel to a rotational axis of the pad assembly. The post is preferably integrally formed with the disk body as a single piece. Furthermore, post 30 projects through an aperture 33 pierced in ring 14. Multiple of the apertures are equally spaced apart in the ring. A distal end of post 30 is deformed in a crimped manner to outwardly expand like a mushroom head thereby creating an enlarged head 34 which is laterally larger than aperture 33. Thus, ring 14 is sandwiched and compressed between head 34 and backside 31 of each disk 16 to mechanically attach and secure the disks to the ring. Adhesive may additionally or instead be employed to attach and secure the disks to the ring with or without the posts, depending on the specific durability requirement and coarseness of the grit for grinding.

It is alternately envisioned that multiple parallel and spaced apart posts may project from each disk for insertion onto aligned apertures of the reinforcement ring. Moreover, it is alternately envisioned that one or more posts can have a generally polygonal shape, a flat side surface or a greater width in one lateral direction than another (e.g., a rectangle or oval). These alternate post configurations deter rotation of the disks relative to the attached reinforcement ring and base pad during grinding. It is alternately envisioned that a threaded bolt shaft or other mechanical fastener post may extend from the backside of the disk, however, some of the advantages of the integral post may not be achieved.

In the example shown, three such tools or disks 16 are secured to peaks 19 about the circumference of reinforcement ring 14 in an equally spaced apart manner. The posts may be solid or at least partially hollow. Furthermore, the ring apertures 33 are preferably circular but may alternately have one or more flat edges, or even be elongated slots in the inner edge 18 or outer edge of ring 14 to engage with a flat surface of the posts.

Many different types of floor-contacting, abrasive patterns may be employed on tools or disks 16. In the exemplary pattern shown, at least 3 and more preferably 5 linearly elongated spokes 64 outwardly radiate from an innermost central groove or depression to a peripheral tapered edge, however, an innermost end of each spoke 64 is offset from a centerline.

Polishing pad 10 could be secured to a paddle of a rotating arm of an electric motor powered floor polishing or grinding machine. Such an attachment may be via a plurality of clips for releasably securing to each paddle and/or with hook-and-loop mechanical fasteners 49 (e.g. Velcro®) removably secured to base pad 12. A plurality of the polishing pads would be secured for rotation about a center axis of the machine head. Alternate powered machines may be used to rotate pad assembly 10 such as those disclosed in the Background section hereinabove.

An insulator 50 acts as a nonconductive spacer between a bottom surface 51 of ring 14 and backside 31 of each tool or disk 16. Each insulator 50 has an annular shape defined by circular inside and outside edges 52 and 53, respectively. Inside edge 52 defines a central aperture and fits snuggly around post 30 in a concentric manner. Outside edge 53 is preferably aligned with the periphery of body 32 of disk 16. Insulator 50 has generally flat top and bottom surfaces with a thickness therebetween of at least 2 mm, and more preferably of 3 mm. Furthermore, insulator 50 is molded from a fiberglass material which includes glass fibers in a polymer. The insulators advantageously reduce heat transferring from metallic bodies 32 of disks 16 to reinforcement ring 14 during floor workpiece abrasion, especially when dry (e.g., without a liquid polish or lubricant) rotation is being performed.

Figure 6:
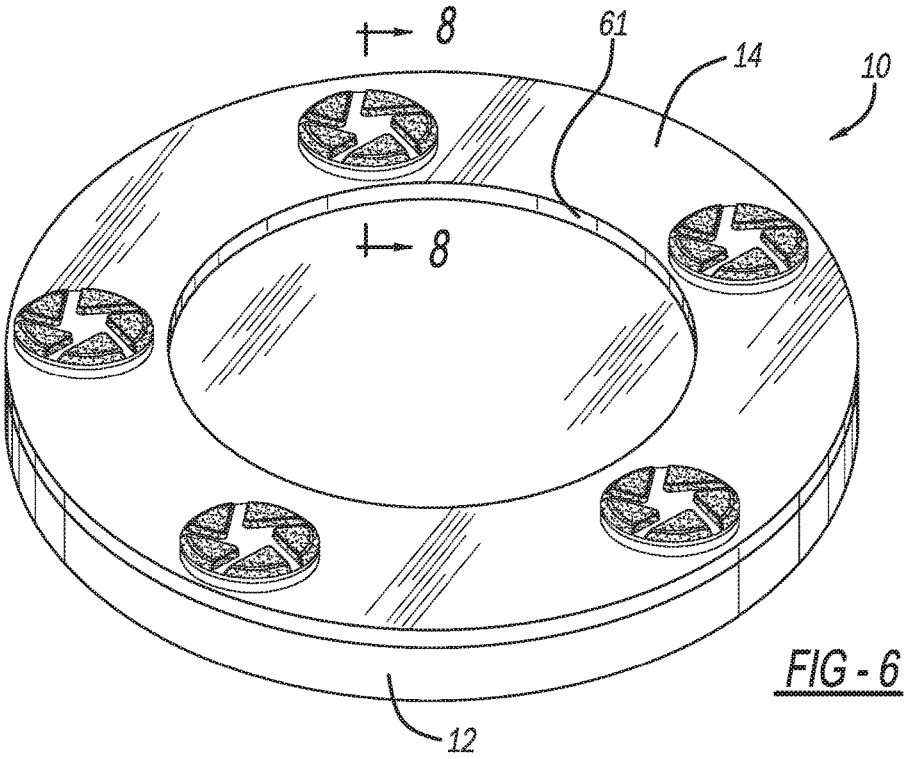
FIG. 6 is a bottom perspective view showing a second embodiment of the pad assembly.
Figure 7:
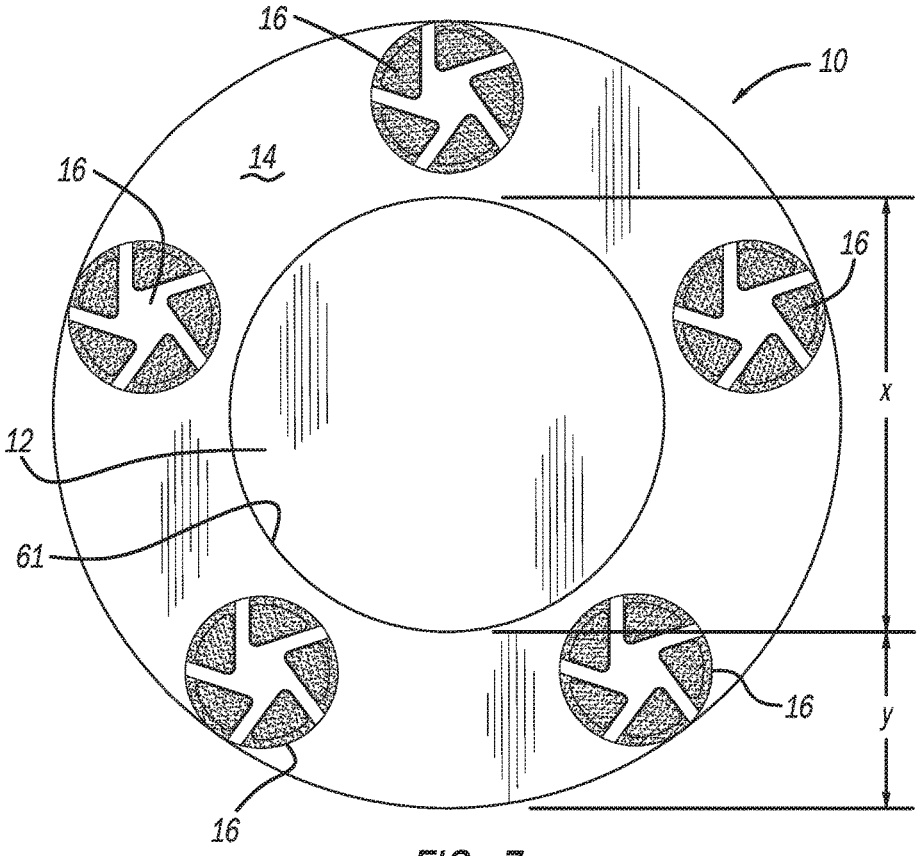
FIG. 7 is a bottom elevational view showing the second embodiment pad assembly.
Figure 8:
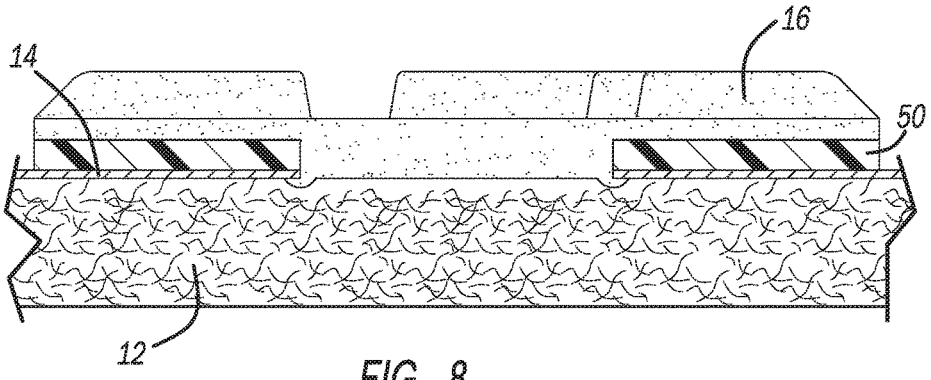
FIG. 8 is a fragmentary cross-sectional view, taken along line 8-8 of FIG. 6, showing a pad variation employed with the second embodiment pad assembly.

Reference should now be made to FIGS. 6-8 for another embodiment of pad assembly 10. A rubber or elastomeric polymer, circular pad 12, metallic reinforcement ring 14, tool disks 16 and insulator 50 are essentially as provided hereinabove. It is noteworthy that an inner edge 61 defining the hole of ring 14 is circular and has a diameter or linear dimension x which is larger than a linear dimension y of a solid section of ring 14 which is adjacent to one side of the hole. More preferably, hole dimension x is a least twice as large as ring dimension y and more preferably, dimension x is 6 inches. The hole relationship of $x>y$ is expected to improve floor contact by the fibrous central portion of pad 12 within the hole defined by internal edge 61 of ring 14.

At least three and more preferably five tools or disks 16 are attached to a lower, floor-facing surface of reinforcement ring or layer 14. Each disk has a diameter of 1-2.5 inches and more preferably 2 inches. This disk size and quantity on pad assembly 10 is ideally suited for floor-grinding. Notwithstanding, the present dimensional relationships, and the arrangement and quantity of disks about the ring, also have ornamental aspects.

Alternately, FIG. 8 illustrates pad 12 made of fibers impregnated with polymeric and diamond materials to provide a floor abrading surface through opening 18. Alternately, pad may be a polymeric foam or felt material.

Figure 9:
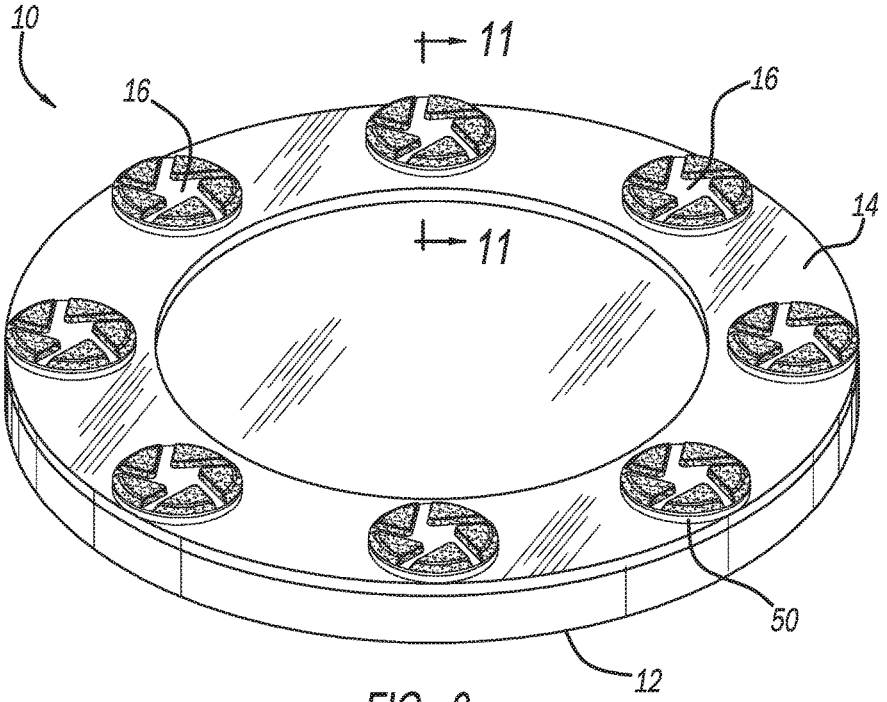
FIG. 9 is a bottom perspective view showing a third embodiment of the pad assembly.
Figure 11:
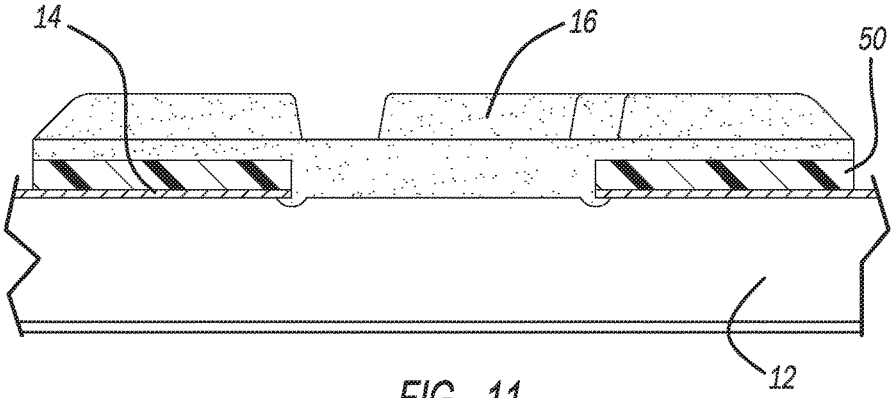
FIG. 11 is a fragmentary cross-sectional view, taken along line 11-11 of FIG. 9, showing the third embodiment pad assembly.
Figure 10:
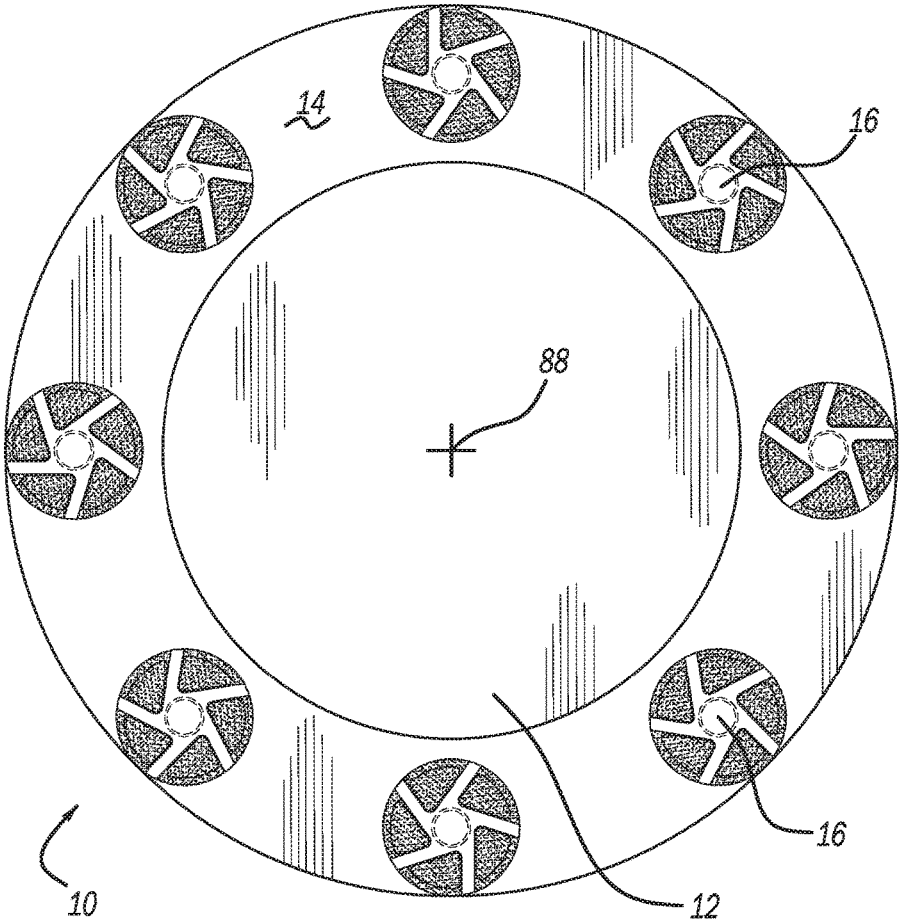
FIG. 10 is a bottom elevational view showing the third embodiment pad assembly.
Figure 12:
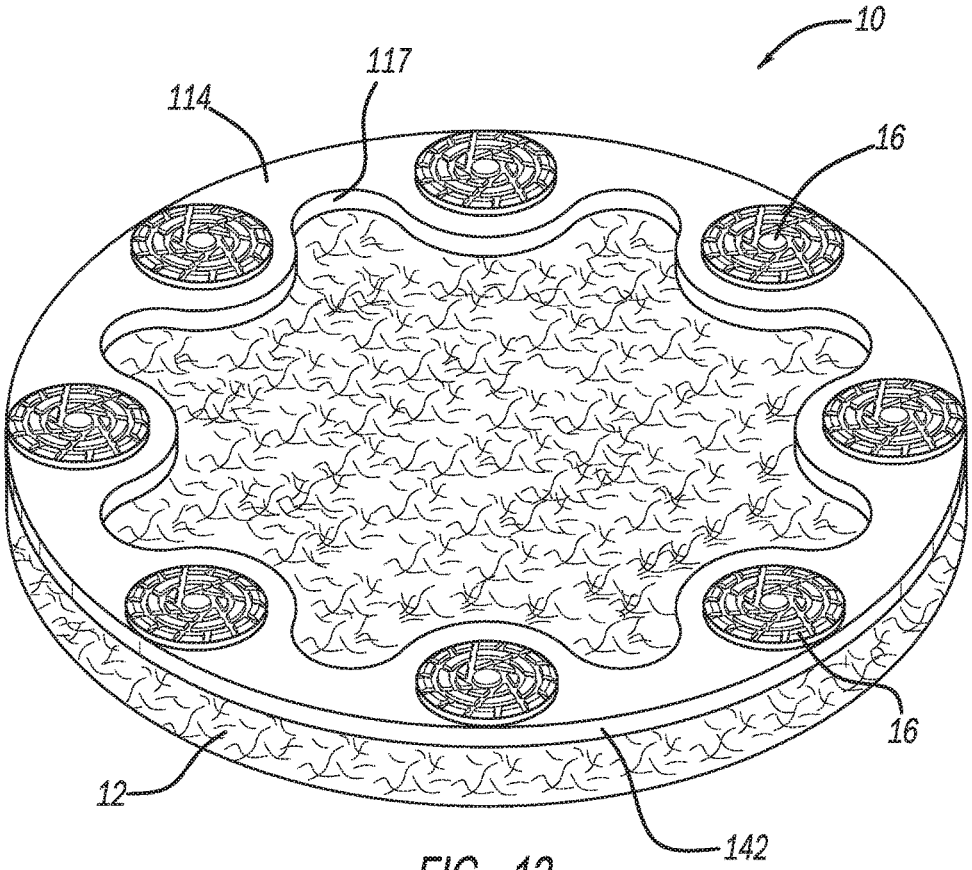
FIG. 12 is a bottom perspective view showing a fourth embodiment of the pad assembly.
Figure 14:
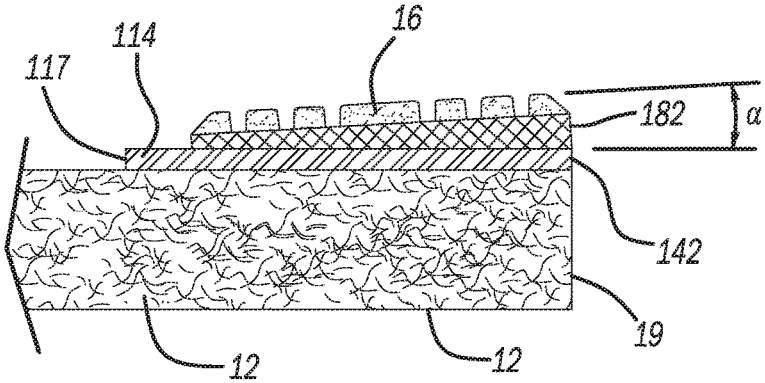
FIG. 14 is a fragmentary cross-sectional view, taken along line 14-14 of FIG. 13, showing the fourth embodiment pad assembly.
Figure 13:
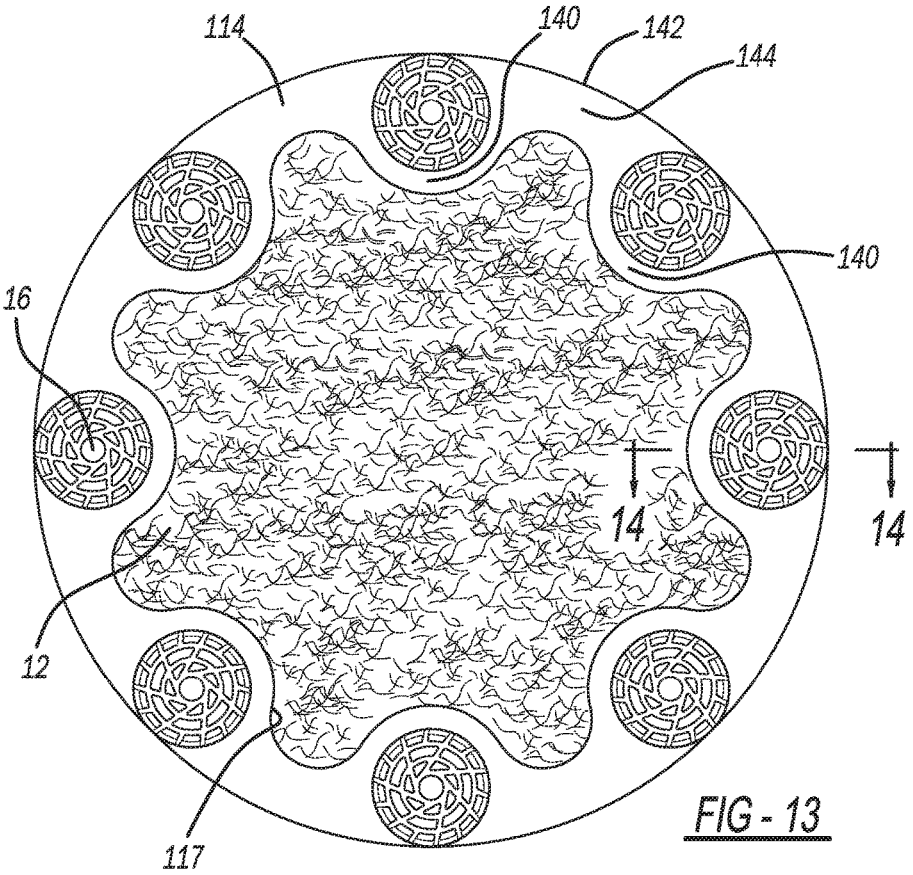
FIG. 13 is a bottom elevational view showing the fourth embodiment pad assembly.

FIGS. 9-11 show another embodiment of pad assembly 10. This configuration is the same as the embodiment of FIG. 6, with insulator 50, except that there are eight of the disks 16 mounted to lower surface 74 of reinforcement ring 14. Disks 16 are all equilaterally spaced apart from each other and are also equally spaced apart from a centerline 88 of pad 12. This configuration is ideally suited for a final polishing operation although, it should also be appreciated that there are ornamental aspects to this embodiment as well.

Reference is now made to FIGS. 12-15. This exemplary embodiment employs a fibrous (or alternately rubber, elastomeric polymer, polymeric foam or felt) pad 12 and disks 16 like that of FIG. 1. A reinforcement ring or layer 114, however, has a wavy or undulating inner edge 117 defining a hole therein to expose a central portion of fibrous pad 12. Ring 114 has peaks 140, with a greater radial distance between an outer peripheral edge 142 and inner edge 117 of ring 114. Spaced between adjacent peaks 140 are radially extending slots and aligned ring valleys 144 where the radial dimension or thickness of the ring is less between outer peripheral edge 142 and inner edge 117 of ring 114. This wavy or undulating ring shape maximizes the center hole area, and thereby floor-to-fibrous pad contact. The hole is essentially surrounded by the abrading tools or disks 16. Nevertheless, there are also ornamental aspects to this design.

Figure 15:
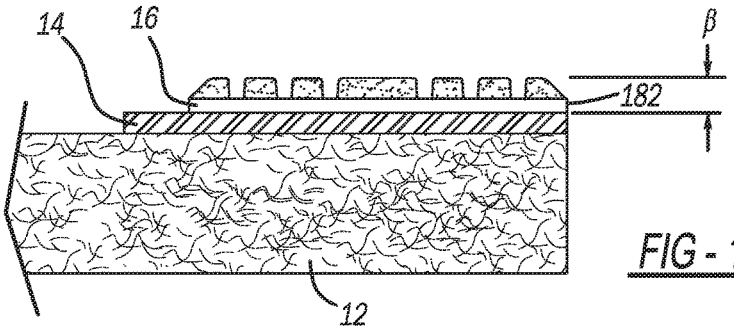
FIG. 15 is a fragmentary cross-sectional view, like that of FIG. 14, showing a variation of the fourth embodiment pad assembly.

While the bottom or working disk nominal surface-to-ring and pad angle $\alpha$ is preferably offset angled by 2-10 degrees, and more preferably at least 4 degrees, (see FIG. 14), it is alternately envisioned in FIG. 15 that such could be given a parallel planar relationship of $\beta$ instead although some of the functional advantages may not be realized. Both of the FIGS. 14 and 15 configurations have the outermost peripheral edge 182 of each disk 16 substantially aligned with peripheral edges 142 of ring 114 and 146 of pad 12. Each radially extending slot between peaks 140 of this exemplary configuration has a smoothly continuous curve with the most outward terminal ends being narrower than the tapered side walls creating the peaks. At least three, and more preferably eight, abrasive tools or disks are employed. No insulators are used but such may alternately be provided. The disks are adhesively bonded to the ring, although the crimped posts may alternately be used. It should be appreciated that the floor-contacting surfaces of the disks may be either angled ⌔ or parallel $\beta$ relative to the floor-facing surfaces of the ring or pad for any of the embodiments herein.

Figure 16:
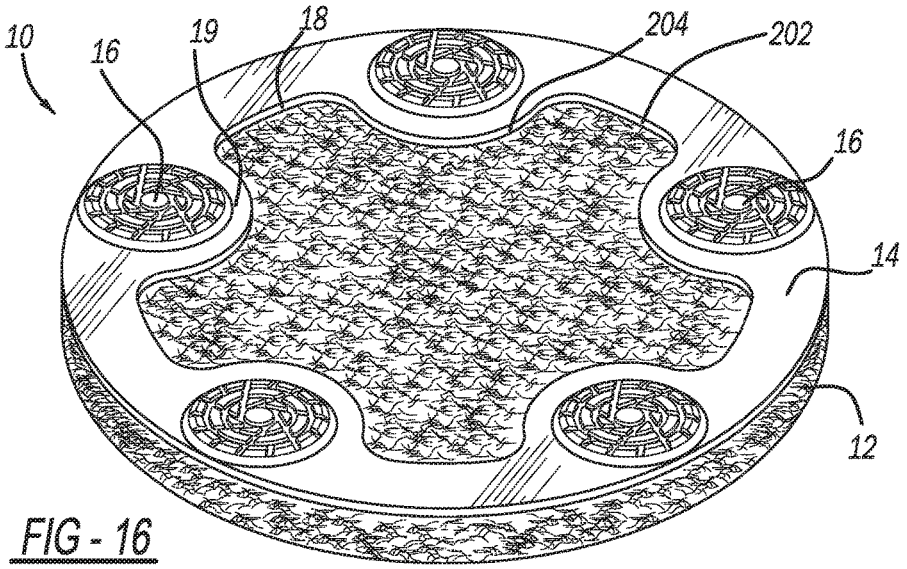
FIG. 16 is a bottom perspective view showing a fifth embodiment of the pad assembly.
Figure 17:
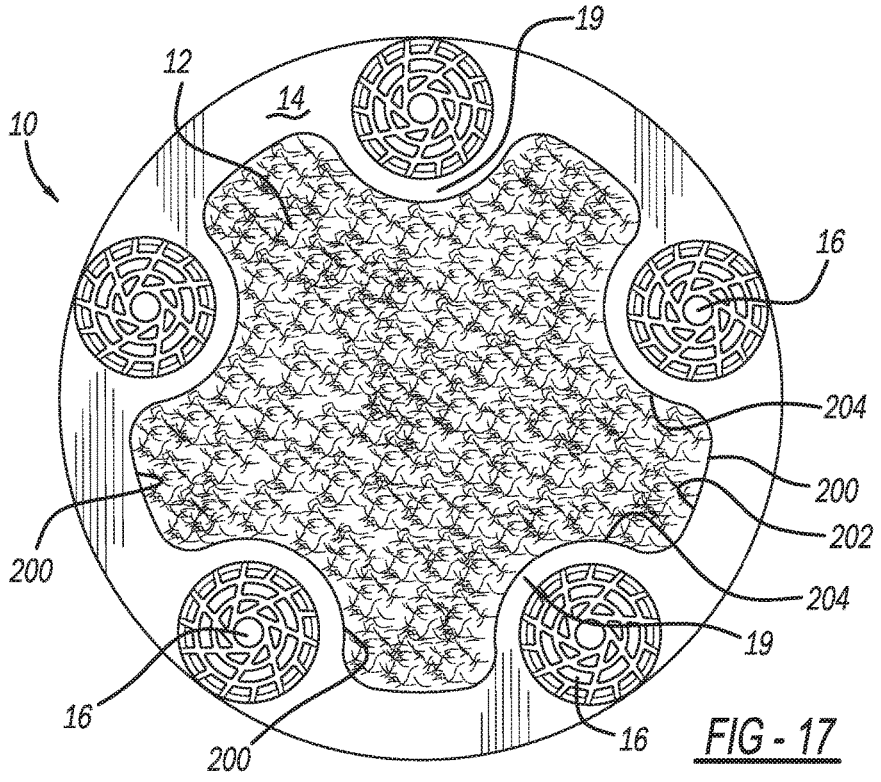
FIG. 17 is a bottom elevational view showing the fifth embodiment pad assembly.

FIGS. 16 and 17 illustrate a five abrasive tool or disk 16 version of the pad assembly 10. It is like that of any of the prior embodiments, with or without insulators and with or without angled abrading surfaces on the disks. However, inner edge 18 of ring 14 has radially extending slots 200 with flat terminal ends 202 and parallel side walls 204 defining at least sections of the adjacent peaks 19. The disks are secured to the radially enlarged and partly circular peaks. A radius is located between end 202 and each adjacent side wall 204.

Figure 18:
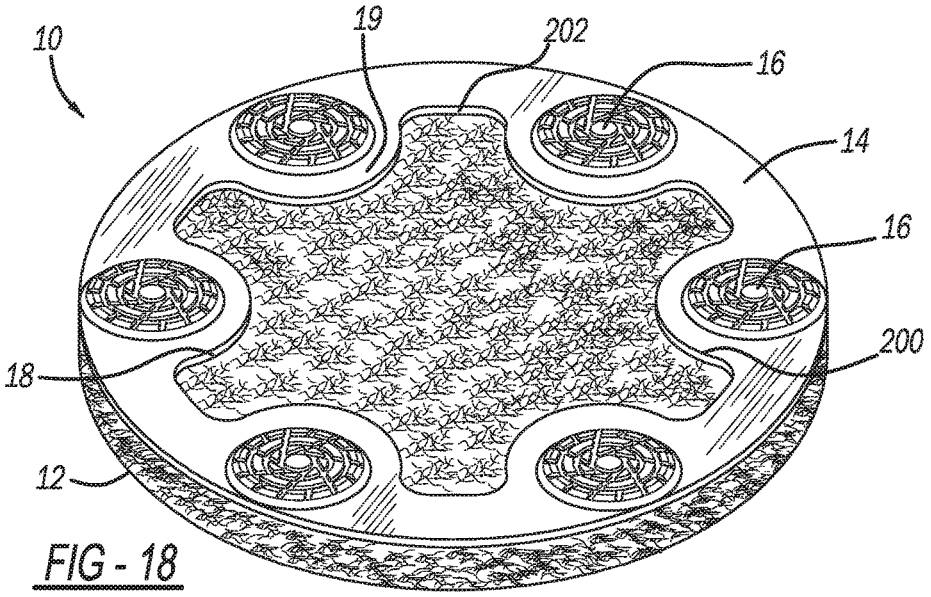
FIG. 18 is a bottom perspective view showing a sixth embodiment of the pad assembly.
Figure 19:
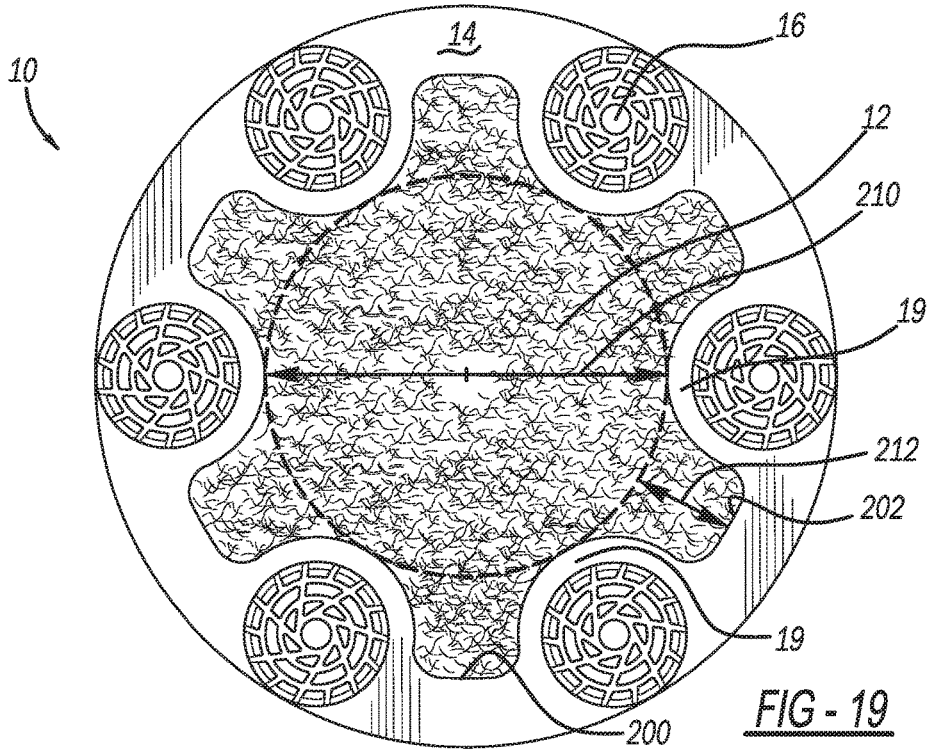
FIG. 19 is a bottom elevational view showing the sixth embodiment pad assembly.

Referring to FIGS. 18 and 19, this embodiment pad assembly 10 is like that of FIG. 16 but there are six abrasive tools or disks 16 with six radially extending slots 200 therebetween. An inner ring diameter 210 is preferably 152.4 mm, and dimension 212 between diameter 210 and end 202 is preferably 38.1 mm. Thus, dimension 212 radially extends at least $1/5^{th}$ of diameter 210 and more than half a diameter of each disk 16.

Figure 20:
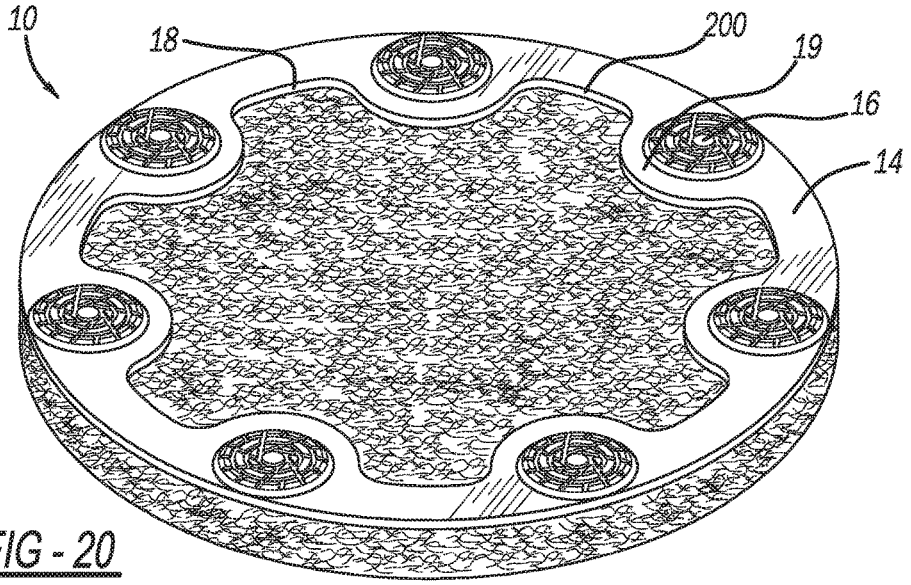
FIG. 20 is a bottom perspective view showing a seventh embodiment of the pad assembly.
Figure 21:
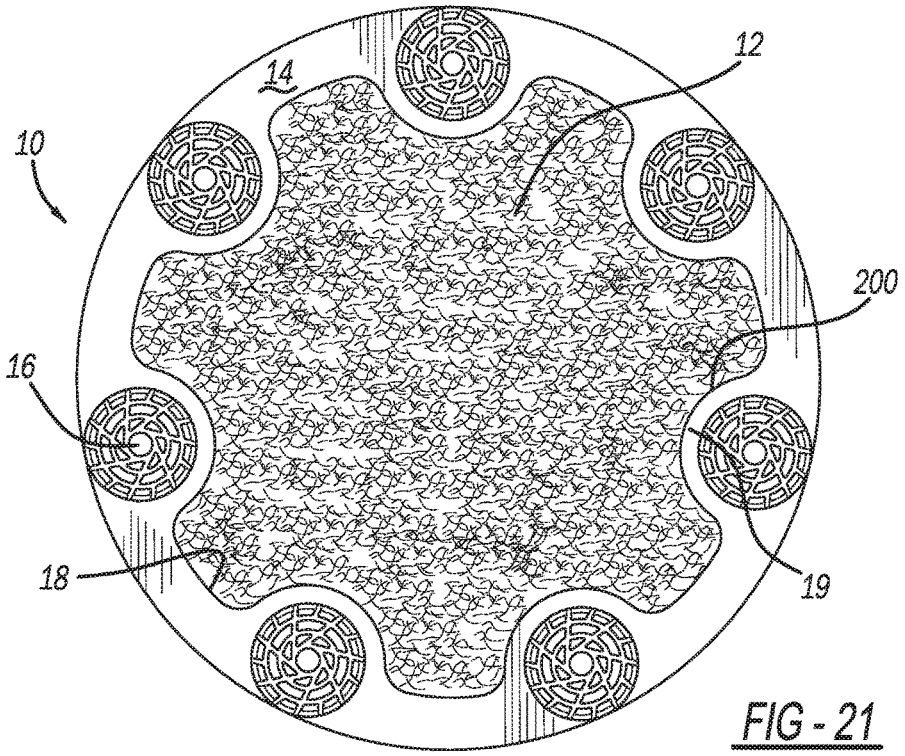
FIG. 21 is a bottom elevational view showing the seventh embodiment pad assembly.

The FIGS. 20 and 21 embodiment pad assembly 10 is essentially the same as that of the preceding version. With this one, however, seven abrasive tools or disks 16 are attached to metallic reinforcement ring 14 which has a wavy or undulating inner edge 18. Inner edge 18 defines 7 slots 200 between seven disk-mounting peaks 19. Again, insulators, posts and/or angled abrading disk surfaces may be employed with this or any of the other embodiments disclosed herein.

While various embodiments have been disclosed, it should be appreciated that additional variations of the pad assembly are also envisioned. For example, while preferred dimensions have been disclosed hereinabove, it should alternately be appreciated that other dimensions may be employed; for example a peripheral pad diameter of at least 10 inches may be employed and disk diameters of 0.5-2.5 inches may also be employed. Moreover, circular peripheral shapes for the pad, reinforcement ring and disks are preferred, however, other arcuate or even generally polygonal peripheral shapes may be used although certain of the present advantages may not be fully realized. While certain materials have been disclosed it should be appreciated that alternate materials may be used although all of the present advantages may not be fully achieved. It is also noteworthy that any of the preceding features may be interchanged and intermixed with any of the others; by way of example and not limitation, any of the disclosed reinforcement ring shapes and/or sizes may be employed with or without angular disks, with any of the aforementioned disk patterns and/or with any of the disk-to-disk positioning. Accordingly, any and/or all of the dependent claims may depend from all of their preceding claims and may be combined together in any combination. Variations are not to be regarded as a departure from the present disclosure, and all such modifications are entitled to be included within the scope and sprit of the present invention.

The invention claimed is:

1. A pad assembly comprising:

a pad including an upper surface, a floor-facing surface and a peripheral surface; and a reinforcement layer attached to the floor-facing surface of the pad, and the reinforcement layer including an internal edge defining a hole therethrough;

wherein the internal edge has a repeating undulating shape including radially oriented peaks with valleys located in between adjacent pairs of the peaks.

2. The pad assembly of claim 1, further comprising disks attached to a floor-facing surface of the reinforcement layer at the peaks.

3. The pad assembly of claim 2, wherein the outer peripheral surface of the pad, and peripheral surfaces of the reinforcement layer and the disks, are all circular, and the pad is flexible.

4. The pad assembly of claim 2, wherein each disk has a floor-contacting nominal surface which is angularly offset by at least two degrees relative to the floor-facing surface of the reinforcement layer.

5. The pad assembly of claim 2, wherein at least one of the disks includes a floor-abrading surface including channels outwardly radiating between a centerline and periphery of the disk, inner ends of the radiating channels being offset from a disk centerline.

6. The pad assembly of claim 1, further comprising floor-abrading tools attached to the reinforcement layer, which is metallic, at the peaks.

7. The pad assembly of claim 6, further comprising a post integrally extending from a backside of each of the tools, the posts being crimped to the reinforcement layer which is flexible.

8. The pad assembly of claim 1, wherein there are at least three peaks, and the undulating shape is arcuate, with a central area of the pad being exposed through the hole of the reinforcement layer such that a linear dimension of the central area within the hole is greater than a linear dimension of one side of the reinforcement layer between the hole and a periphery thereof.

9. The pad assembly of claim 1, further comprising an insulator disposed between an abrasive body of a tool and the reinforcement layer to which the tool is attached, the reinforcement layer being a flexible metallic material.

10. A pad assembly comprising:

a fibrous pad including an upper surface, a floor-facing surface and a peripheral surface; and a reinforcement layer attached to the floor-facing surface of the pad, and the reinforcement layer including an internal edge defining a hole therethrough;

wherein the internal edge has a repeating undulating shape including at least four radially oriented peaks with valleys located in between adjacent pairs of the peaks.

11. The pad assembly of claim 10, further comprising disks attached to a floor-facing surface of the reinforcement layer at the peaks.

12. The pad assembly of claim 11, wherein the outer peripheral surface of the fibrous pad, and peripheral surfaces of the reinforcement layer and the disks, are all circular, and the pad is flexible and includes diamond abrasive particles.

13. The pad assembly of claim 11, wherein each disk has a floor-contacting nominal surface which is angularly offset by at least two degrees relative to the floor-facing surface of the reinforcement layer.

14. The pad assembly of claim 11, wherein at least one of the disks includes a floor-abrading surface including channels outwardly radiating between a centerline and periphery of the disk, the pattern further including circular channels intersecting the curved and radiating channels, and the disk including a solid center without an aperture therein, inner ends of the radiating channels being offset from a disk centerline, and the disks all including a polymeric material which is adhesively bonded to the reinforcement layer.

15. The pad assembly of claim 11, wherein at least one of the disks includes a floor-abrading pattern including at least ten concentric circles, with all of the disks adhesively bonded to the reinforcement layer.

16. The pad assembly of claim 10, wherein there are at least eight peaks, and the undulating shape is arcuate, with a central area of the pad being exposed through the hole of the reinforcement layer such that a linear dimension of the central area within the hole is greater than a linear dimension of one side of the reinforcement layer between the hole and a periphery thereof.

17. The pad assembly of claim 10, further comprising fasteners coupled to a top surface of the pad adapted for removable attachment to paddles of a rotating floor polishing or grinding machine.

18. A pad assembly comprising:

a flexible and rotatable pad including an upper surface, a floor-facing surface and a peripheral surface;

a flexible reinforcement ring attached to the floor-facing surface of the pad, and the reinforcement ring including a circular external edge and an internal edge defining a hole therethrough;

the internal edge including alternating radially extending slots and radially enlarged peaks, defining an opening through which a portion of the pad is exposed; and floor-contacting abrasive tools attached to the reinforcement ring.

19. The pad assembly of claim 18, further comprising a post extending from a backside of each of the tools and being attached through a hole in the reinforcement ring, the post extending through a central aperture in an insulator, and multiples of the insulator being equally spaced apart on the reinforcement ring.

20. The pad assembly of claim 19, wherein the post is integral with the associated tool as a single piece.

21. The pad assembly of claim 18, wherein the tools are circular disks attached to a floor-facing surface of the reinforcement ring at the peaks located between the slots.

22. The pad assembly of claim 18, wherein there are at least three of the peaks, and the internal edge shape of the ring is arcuate, with a central area of the pad being exposed through the opening of the reinforcement ring such that a linear dimension of the central area within the opening is greater than a linear dimension of one side of the reinforcement ring between the opening and a periphery thereof.

23. The pad assembly of claim 18, wherein the pad is fibrous and includes diamond abrasive particles.

24. The pad assembly of claim 18, wherein each of the slots of the internal edge of the reinforcement ring includes a flat terminal end wall bordered by at least partially straight side walls.

25. The pad assembly of claim 18, wherein each of the slots of the internal edge of the reinforcement ring includes an arcuate terminal end wall bordered by inwardly opening tapered side walls.

26. The pad assembly of claim 18, wherein each of the slots of the internal edge of the reinforcement ring includes a narrower neck dimension which is less than a lateral dimension adjacent a terminal end wall.

27. The pad assembly of claim 18, wherein each of the slots of the internal edge of the reinforcement ring includes a continuously curved shape with at least three of the slots being present in the reinforcement ring.

28. A pad assembly comprising:

a flexible pad including an upper surface, a floor-facing lower surface and a peripheral surface;

a flexible reinforcement layer attached to a bottom surface of the pad;

abrasive tools attached to a floor-facing surface of the reinforcement layer; and an insulator located between a section of each of the tools and the reinforcement layer;

wherein the insulator includes a circular peripheral edge and a central hole.

29. The pad assembly of claim 28, wherein:

the peripheral surface of the pad is circular;

a periphery of the reinforcement layer is circular and substantially aligned with the peripheral surface of the pad; and the tools are all substantially equally spaced away from a centerline of the pad.

30. The pad assembly of claim 28, wherein there are at least three of the tools which are circular disks, attached to the reinforcement layer.

31. The pad assembly of claim 28, wherein each of the tools has a floor-contacting nominal surface which is angularly offset by at least two degrees relative to the floor-facing surface of the reinforcement layer.

32. The pad assembly of claim 28, wherein each of the tools is a circular disk having a floor-contacting nominal surface which is angularly offset by at least four degrees relative to the floor-facing surface of the reinforcement layer.

33. The pad assembly of claim 28, further comprising an internal edge of the reinforcement layer being circular such that the reinforcement layer has an annular shape.

34. The pad assembly of claim 28, further comprising an internal edge of the reinforcement layer has an arcuately wavy shape including the peaks, and the pad being rotatable about a center axis thereof.

35. The pad assembly of claim 28, wherein the insulator is fiberglass.

36. The pad assembly of claim 28, further comprising an integrally formed post extending from a backside of each of the tools, the integrally formed post extending through a hole in the insulator.

37. The pad assembly of claim 28, wherein the reinforcement layer is metallic, there are multiples of the insulator which are spaced apart from each other and aligned with the tools, the insulators deter heat transfer from the tools to the reinforcement layer, and the tools and the reinforcement layer are metallic.

38. The pad assembly of claim 28, further comprising fasteners coupled to the top surface of the pad adapted for removable attachment to a rotating floor polishing or grinding machine.

39. The pad assembly of claim 28, being a machine-powered floor polishing pad assembly.

40. The pad assembly of claim 28, being a machine-powered floor grinding pad assembly.

41. The pad assembly comprising:

a flexible and rotatable pad including a circular peripheral surface;

a metallic reinforcement ring with a substantially circular peripheral surface;

workpiece-abrading tools coupled to the reinforcement ring;

spacers located between the tools and the reinforcement ring, the spacers including a polymeric or fiberglass material;

the spacers being spaced apart from each other and aligned with the tools; and an integrally formed post extending from a backside of each of the tools, the integrally formed post extending through a hole in an aligned one of the insulators.

42. The pad assembly of claim 41, wherein the spacers each include a circular peripheral edge and substantially flat top and bottom surfaces.

43. The pad assembly of claim 41, further comprising a fastener extending from a backside of each of the tools, the fastener extending through a hole in an aligned one of the insulators.

44. The pad assembly of claim 41, wherein a distal end of the post is crimped to the reinforcement ring which is flexible.

45. The pad assembly of claim 41, further comprising an internal edge of the reinforcement ring being circular such that the reinforcement ring has an annular shape.

46. The pad assembly of claim 41, further comprising an internal edge of the reinforcement ring having an arcuately wavy shape including peaks and valleys, the reinforcement ring being linearly larger at the peaks than at the valleys, and one of the tools being located within each of the peaks.

47. The pad assembly of claim 41, being a machine-powered floor polishing pad assembly.

48. The pad assembly of claim 41, being a machine-powered floor grinding pad assembly.

49. A method of making an abrasive pad assembly, the method comprising:

(a) attaching a metallic and flexible reinforcement layer adjacent to a periphery of a thicker, flexible and rotatable pad on a workpiece-facing surface of the pad;

(b) locating insulators against a workpiece-facing side of the reinforcement layer;

(c) attaching workpiece abrading tools to the reinforcement layer or insulators such that the insulators are sandwiched between at least a lateral enlarged section of each of the tools and the reinforcement layer;

(d) inserting a post extending from a backside of each of the tools through a central hole in an associated one of the insulators; and (e) securing the post to a top surface of the reinforcement layer.

50. The method of claim 49, wherein:

the reinforcement layer has an internal edge through which the pad is exposed;

the insulators are fiberglass and/or polymeric annular spacers; and the pad assembly is a floor-polishing or grinding pad assembly.

51. A pad assembly comprising:

a flexible pad including an upper surface, a floor-facing lower surface and a peripheral surface;

a flexible reinforcement layer attached to a bottom surface of the pad;

abrasive tools attached to a floor-facing surface of the reinforcement layer;

an insulator located between a section of each of the tools and the reinforcement layer; and a fastener extending from a backside of at least one of the tools, the fastener extending through a hole in the insulator.

52. The pad assembly of claim 51, wherein:

the peripheral surface of the pad is circular;

a periphery of the reinforcement layer is circular and substantially aligned with the peripheral surface of the pad; and the tools are all substantially equally spaced away from a centerline of the pad.

53. The pad assembly of claim 51, wherein there are at least three of the tools which are circular disks, attached to the reinforcement layer.

54. The pad assembly of claim 51, further comprising an internal edge of the reinforcement layer being circular such that the reinforcement layer has an annular shape.

55. The pad assembly of claim 51, further comprising an internal edge of the reinforcement layer has an arcuately wavy shape, and the pad being rotatable about a center axis thereof.

56. The pad assembly of claim 51, wherein the insulator includes a circular peripheral edge aligned with a circular periphery of the associated tool.

57. The pad assembly of claim 51, wherein the insulator has substantially flat top and bottom surfaces, the reinforcement layer contacting against the top surface of the insulator.

58. The pad assembly of claim 51, wherein the insulator is fiberglass.

59. The pad assembly of claim 51, wherein the fastener includes an integrally formed post extending from a backside of the at least one of the tools.

60. The pad assembly of claim 51, wherein the reinforcement layer is metallic, there are multiples of the insulator which are spaced apart from each other and aligned with the tools, the insulators deter heat transfer from the tools to the reinforcement layer, and the tools and the reinforcement layer are metallic.

61. The pad assembly of claim 51, being a machine-powered floor polishing pad assembly.

62. The pad assembly of claim 51, being a machine-powered floor grinding pad assembly.

* * * * *